US008865263B2

(12) United States Patent
Sharoyan et al.

(10) Patent No.: US 8,865,263 B2
(45) Date of Patent: Oct. 21, 2014

(54) PAPERMAKING ADDITIVES FOR ROLL RELEASE IMPROVEMENT

(75) Inventors: Davit E. Sharoyan, Hockessin, DE (US); Tien-Feng Ling, Newark, DE (US); Scott T. Schnelle, West Grove, PA (US)

(73) Assignee: Solenis Technologies, L.P., Wilmington, DE (US)

( * ) Notice: Subject to any disclaimer, the term of this patent is extended or adjusted under 35 U.S.C. 154(b) by 550 days.

(21) Appl. No.: 13/214,472

(22) Filed: Aug. 22, 2011

(65) Prior Publication Data

US 2012/0045587 A1 Feb. 23, 2012

Related U.S. Application Data

(60) Provisional application No. 61/376,065, filed on Aug. 23, 2010.

(51) Int. Cl.

| | |
|---|---|
| ***B05D 1/02*** | (2006.01) |
| ***D21H 25/04*** | (2006.01) |
| ***D21F 3/00*** | (2006.01) |
| ***D21F 3/08*** | (2006.01) |
| ***D21F 3/02*** | (2006.01) |
| *D21H 21/02* | (2006.01) |
| *D21H 25/00* | (2006.01) |
| *D21H 21/14* | (2006.01) |

(52) U.S. Cl.

CPC ..... *D21H 25/04* (2013.01); *Y10S 162/04* (2013.01); *D21H 21/02* (2013.01); *D21F 3/00* (2013.01); *D21H 25/005* (2013.01); *D21H 21/146* (2013.01); *D21F 3/08* (2013.01); *D21F 3/02* (2013.01)

USPC ..... 427/425; 427/420; 162/199; 134/32; 134/33; 106/38.24; 492/20; 162/DIG. 4

(58) Field of Classification Search

None

See application file for complete search history.

(56) References Cited

U.S. PATENT DOCUMENTS

| | | | | |
|---|---|---|---|---|
| 3,198,695 | A * | 8/1965 | Justus | 162/359.1 |
| 3,326,835 | A * | 6/1967 | Signorelli et al. | 524/488 |
| 4,704,776 | A | 11/1987 | Watanabe et al. | |
| 5,023,132 | A * | 6/1991 | Stanley et al. | 442/195 |
| 5,520,781 | A * | 5/1996 | Curham et al. | 162/199 |
| 6,051,108 | A | 4/2000 | O'Neal, Jr. | |
| 6,139,911 | A | 10/2000 | Vanhecke et al. | |
| 6,187,137 | B1 * | 2/2001 | Druecke et al. | 162/109 |
| 6,187,143 | B1 * | 2/2001 | Juppo et al. | 162/158 |
| 6,365,000 | B1 | 4/2002 | Dwiggins | |
| 6,468,394 | B1 * | 10/2002 | Sekiya et al. | 162/135 |
| 6,558,513 | B1 | 5/2003 | Pease et al. | |
| 6,723,207 | B2 | 4/2004 | Laser | |
| 2004/0020549 | A1 * | 2/2004 | Augscheller et al. | 139/383 A |
| 2006/0052019 | A1 * | 3/2006 | Crook, Jr. | 442/268 |
| 2006/0275604 | A1 * | 12/2006 | Clement et al. | 428/364 |
| 2008/0268158 | A1 * | 10/2008 | Fugitt et al. | 427/373 |
| 2009/0159229 | A1 | 6/2009 | Sekiya et al. | |

FOREIGN PATENT DOCUMENTS

| | | |
|---|---|---|
| EP | 0506455 | 9/1992 |
| EP | 0647737 | 4/1995 |
| EP | 1126079 | 8/2001 |
| EP | 1473405 | 11/2004 |
| EP | 1241225 | 9/2009 |
| WO | 96/026997 | 9/1996 |
| WO | 97/04166 | 2/1997 |
| WO | 97/11225 | 3/1997 |
| WO | 2008/063268 | 5/2008 |
| WO | 2010/047409 | 4/2010 |

OTHER PUBLICATIONS

Form PCT/ISA/210 International Search Report, Oct. 26, 2011, pp. 4.

* cited by examiner

*Primary Examiner* — Timothy Meeks
*Assistant Examiner* — Michael P Rodriguez
(74) *Attorney, Agent, or Firm* — Michael J. Herman; Joanne Rossi

(57) ABSTRACT

Compositions and methods for reduction in adhesion between wet paper web and roll surfaces in papermaking process are disclosed. The method is particularly useful for improvements in press section roll release.

19 Claims, No Drawings

PAPERMAKING ADDITIVES FOR ROLL RELEASE IMPROVEMENT

This application claims priority of U.S. Provisional Application No. 61/376,065, filed Aug. 23, 2010, the entire contents of which are herein incorporated by reference

FIELD OF THE INVENTION

The present invention provides a convenient and easy method for improvement of roll release in papermaking processes. The method consists of adding treatments to the surface of a central roll or other surfaces in the press section of a paper machine. Applied compositions may contain hydrophobic imidazolines alone or in combination with other hydrophobically modified amines, ammonium, mono-, di-, tri-alkyl ammonium or other amine or ammonium containing cationic surfactants and also hydrophobic actives like vegetable or mineral oils, alkanes, paraffins, polybutenes, waxes, etc. Non-ionic surfactants can also be added to these mixtures to enhance the roll release effect.

BACKGROUND OF THE INVENTION

A papermaking process consists of the formation of a paper sheet from aqueous slurry of pulp and additives and then gradual removal of water from the wet paper. Water removal by itself is comprised of several stages. In the first part of the process, termed the wet end, water is removed by gravity, vacuum suction and then the pressing of wet paper by press rolls. In the later part of the dewatering process termed the dryer section, residual water is removed by heating and evaporating it off of heated surfaces.

When the paper web reaches the press section of a paper machine, the paper consistency is about 20-25%. In this section pressure is applied to the paper by a series of press rolls to expel water and make paper sheet smoother. Paper consistency rises to 40-50% after pressing. Upon this reduction of water content fibers come into close proximity to each other and the degree of association and bonding grows significantly. Fibers not only adhere to each other but also tend to adhere to roll surfaces creating a drag in the paper web flow. Surface tension and adhesion between paper and roll surfaces grows significantly. In addition, deposition of sticky materials like pitch, extractives, organic solids, inorganic fillers and fine fibers onto roll surfaces can also hinder paper web release from roll surfaces. These issues are especially significant with paper made from recycled or resin containing pulps.

Increased paper adhesion and deposition of contaminants onto the roll surfaces may affect the runnability of the web eventually causing disruptions or breaks in the process. To compensate for this increased adhesion of the paper it becomes necessary to pull with additional force or to "draw" the paper web as it is transferred onto the next section of paper machine. However, increasing the draw has its own consequences and may negatively impact paper quality or cause breaks. To avoid these undesirable effects, a number of treatments have been utilized. These include modifications in roll cover materials, mechanical removal of deposits by doctor blades and/or application of paper release agents.

A number of different chemistries have been applied and practiced to enhance roll release. Several applications describe compositions containing hydrophobic actives or emulsions. For example, U.S. Pat. No. 6,468,394 discloses application of wax emulsions onto roll surfaces, wherein said wax should have a melting point below 60° C. According to this method, the wax melts on the warm roll surfaces forming a hydrophobic film thereby facilitating paper release from the roll surface. The other application, U.S. Pat. No. 6,558,513 teaches a method of improving the release of paper webs from the surfaces of press rolls by applying non-aqueous, non-curing hydrocarbon compositions, in which the preferred materials are hydrocarbon polymers, polybutenes with preferred molecular weight to be in the range from 400 to 700.

A method described in U.S. Pat. No. 6,139,911 discloses improvement in release properties by application of additives in the form of dilute microemulsions. Active components are selected from the group of oils, waxes, water insoluble surfactants and polymers. The application of stable emulsions based on an alcohol, a fatty acid or oil, lecithin, and water soluble or water dispersible surfactant is described in WO1996/26997.

U.S. Pat. No. 6,723,207 discloses application of a blend of cationic water soluble polymer, non-ionic surfactant and anionic surfactant to the papermaking roll. The composition has an overall positive charge. The cationic polymer is preferably quaternary ammonium compound like poly-diallyldimethylammonium chloride.

The patent application US2009/0159229 discloses compositions applied to press roll for improvement of detachability of wet paper. The compositions of the actives applied onto press roll surface are based on functionalized polyoxyethylene-polyoxypropylene block polymers.

WO1997/11225 discloses the treatment of central rolls in the press section by aqueous enzyme solutions wherein at least one substance adheres to the surface of the roil and "improves the reliability of the moving element in the process of paper production".

U.S. Pat. No. 6,051,108 discloses removing or preventing the buildup of deposits in papermaking wet press felts and on forming wires. The cleaning solutions contain at least one acidic cleaning compound and peracetic acid.

U.S. Pat. No. 4,704,776 discloses silicone oil, silicone plastic and fluoroplastic as release agents for paper machine press rolls. WO2008/063268 discloses preparation of linear or branched fluorinated polymers with at least one urea linkage. Polymers are designed for surface treatments including surface cleaning, textile treatments, stain release improvement and others.

SUMMARY OF THE INVENTION

The present invention relates to compositions and methods for the reduction of adhesion forces between a paper web and the roll surfaces of a papermaking machine hence improving the release of paper from roll surface. The method comprises the application of hydrophobic imidazolines alone or in combination with one or more of a) other hydrophobically modified amines b) other hydrophobic materials, c) non-ionic surfactants or d) mixtures thereof to the roll surfaces.

The proposed compositions can be applied by sprays or by rollers to the surfaces of interest. These compositions presumably make surfaces more hydrophobic hence making the paper web less adherent to the press roll.

In one preferred embodiment, the present invention relates a method of reducing paper adhesion to roll surface by applying a mixture of hydrophobic imidazoline, vegetable or mineral oil or fatty acid alkyl ester, in combination with one or more non-ionic surfactants.

In another preferred embodiment, the present invention relates a method of reducing paper adhesion to roll surface by applying a mixture of hydrophobic imidazoline, vegetable oil in combination with non-ionic surfactant and low molecular weight polybutene.

DETAILED DESCRIPTION OF THE INVENTION

The present invention discloses compositions and methods to be used for the reduction of adhesion between paper webs and roll surfaces. The compositions applied to the roll surfaces comprise hydrophobic imidazoline. The invention discloses applying to a roll surfaces compositions comprising low molecular weight hydrophobic imidazoline and optionally at least one of a) hydrophobically modified amine, b) hydrophobic materials such as mineral or vegetable oils or alkyl derivatives thereof, polybutenes, waxes, paraffins, hydrophobically modified silica or silicones, hydrophobic phosphate esters, hydrophobically modified polymers, hydrophobically modified carbohydrates or any other hydrophobes, c) non-ionic surfactants such as linear alcohol ethoxylates, branched alcohol ethoxylates, polyoxyethylene-polyoxypropylene block copolymers, polyethylene glycol esters, mono- and di-esters of various fatty acids, ethoxylated polymethyl-alkylsiloxanes and others or d) mixtures thereof, and applying these hydrophobic mixtures or their aqueous emulsions to the surfaces in papermaking machines to reduce the adhesion of paper web and reduce the resulting draw on paper machine.

By "hydrophobically modified amines" we mean low molecular weight amines or ammonium containing compounds with the nitrogen of an amine or ammonium group bound to a hydrophobic or fatty group like a hydrocarbon or a fluorocarbon chain; amines could be linear or branched fatty alkyl amines or ammonium compounds, aminoamides, fluorinated amines and others. For the purposes of this invention, hydrophobically modified amines do not include imidazolines By "vegetable oil", it is defined to mean oils from plant sources; examples include, but are not limited to soybean oil, corn oil, rapeseed oil, castor oil, castor oil derivatives and mixtures thereof and the like. By "mineral oil", it is defined to mean oils from mineral sources like a mixture of linear, branched and aromatic hydrocarbons, paraffins, and waxes.

The "alkyl derivatives" of vegetable oil is defined to mean the ester derivative resulting from transesterification of the vegetable oil with an alcohol. Examples of vegetable oil esters include but are not limited to soybean oil alkyl ester, corn oil alkyl ester, canola (rapeseed) oil ester, alkyl palmitate, alkyl oleate, alkyl stearate and others.

By "non-ionic surfactants", it is meant to define compositions comprising e.g. alkyl and ethylene glycol units where a part of the composition is hydrophobic and a part is hydrophilic. Examples of non-ionic surfactants include but are not limited to linear alcohol ethoxylates, branched alcohol ethoxylates, alcohol alkoxylates, polyoxyethylene-polyoxypropylene block copolymers, polyethylene glycol esters are mono- and di-esters of various fatty acids, aliphatic polyethers, ethoxylated polymethyl-alkylsiloxanes, alkyl polyglucosides, ethoxylated sorbitan derivatives, sorbitan fatty acid esters, alkyl phenyl ethoxylates, and alkoxylated amines.

According to the present invention, low molecular weight hydrophobic imidazoline are very efficient in reduction of adhesion forces and can be used for roll release. The most preferable would be hydrophobic imidazoline with cyclic imidazoline structures comprising one, two or several hydrophobic chains (with 10 to 24, preferably 16 to 18 carbon atoms in hydrophobic chain) in the molecular composition. The molecular weight of the imidazoline useful for the present invention does not exceed 1,000 daltons, preferably the molecular weight is less than 800 daltons.

The list of hydrophobically modified amines includes but is not limited to hydrophobic linear or branched fatty alkyl (primary, secondary, tertiary) amines or quaternary ammonium compounds; with one or several hydrophobic chains, aminoamides, amines with perfluoroalkyl groups, polymeric amines, polymeric aminoamides, and polymeric amines or aminoamides with perfluoroalkyl groups. The amine can also be selected from fatty amine carboxylates, amidoamines, fatty alkanolamines, and amphoteric amines like betaines.

Higher molecular weight amines (e.g. polydiallyldimethylammonium chloride ("Polydadmac"), cationic polymeric product with molecular weight of 100,000 daltons, hydrophobically modified polyaminoamide with molecular weight at 9,000 daltons and others) appear not as effective in reduction of adhesion forces as low molecular weight amines.

The preferred imidazolines are those which include imidazoline cyclic structures with one or two hydrophobic groups attached to it. Imidazolines are products of the reaction between fatty acids (e.g. oleic acid, palmitic acid, or stearic acid) with diethylenetriamine or amonoethylethanolamine and subsequent quaternization of resulted amidoamine by diethylsulfate, dimethylsulfate or acetic acid. The number of hydrophobic chains depends on the ratio of fatty acid and amine. Preferably the ratio is 1:1 or 2:1.

Degree of cyclization in imidazoline product depends on reaction conditions. Under optimum conditions it could be ~90% cyclized. In other cases it could be a mixture of cyclized imidazoline and linear aminoamides.

Imidazolines absorb strongly to negatively charged surfaces of metals, fibers, glass or minerals and make them hydrophobic. Imidazolines are used as lubricants, anticorrosive agents, fabric softeners and antistatic agents.

The low molecular weight imidazolines appear to effectively adhere to the surfaces making the surfaces hydrophobic. Many of these amines are fairy soluble in water and can be easily applied as aqueous solutions. In the cases of low solubility actives, alternative options for application could include blending with non-ionic surfactants or using them with acidified buffers.

Hydrophobic materials (e.g. vegetable and mineral oils, waxes, polyolefines, polybutenes) have been mentioned in prior art as efficient treatments for roll release (e.g. see U.S. Pat. No. 6,468,394 or U.S. Pat. No. 6,558,513). The applications of these chemistries are not always simple and straightforward since many of them are solids or viscous liquids and they do not mix with water. Many of these materials can be better utilized as oil in water emulsions. Application of emulsified hydrophobic materials has been known and has been practiced for many years. The application of these treatments as emulsions may not lead to a desirable effect due to instability of emulsions or inability of the hydrophobes to remain on the roll surface for prolonged period of time. These effects eventually can lead to inefficient economic profile of the treatments.

Non-ionic surfactants alone have shown moderate effects in adhesion force reductions. Their effect is presumably due to the reduction of interfacial tension at the paper and roll interface. Addition of non-ionic surfactants to hydrophobic materials helps in emulsifying hydrophobic materials (e.g. oils). It also promotes more efficient delivery and spread of hydrophobes on the surfaces of interest. According to the present invention the HLB of effective non-ionic surfactants varies in the range of 0 to 20, preferably from 4 to 15, with more preferably HLB values to be from 8 to 12.

It has been found that combining water miscible hydrophobic imidazolines with non-water soluble hydrophobes leads to greater improvements in roll release. Compositions of hydrophobic imidazolines with hydrophobic materials e.g. vegetable or mineral oils or vegetable oil alkyl esters, and non-ionic surfactants demonstrate synergistic behavior in reduction of paper web adhesion to roll surfaces.

Possible explanations for the observed synergy could be attributed to, but not limited to the cyclic and linear amine structures in the imidazoline component which adhere strongly to the roll surfaces and form hydrophobic monolayers. The imidazoline layer helps in the spreading of vegetable oil and anchoring of the oil or any other hydrophobic material to the roll surface. Due to the formation of imidazoline coating layer, hydrophobic materials remain on the surface longer, thus improving the economy of treatment.

The hydrophobically modified amine used in the invention can be a primary, secondary, tertiary or quaternary amine or ammonium compound; containing one, two or several hydrophobic groups like linear, branched, aromatic hydrocarbon chains or perfluorinated groups. For purposes of this invention hydrophobically modified amines do not include imidazoline.

The hydrophobic material can be vegetable or mineral oil, vegetable oil alkyl ester, vegetable oil derivative, fatty acid ester, or any type of hydrocarbon or fluorinated material.

The hydrophobic material can be soybean oil, corn oil, canola oil, coconut oil, clove oil, thyme oil, eucalyptus oil, soybean oil alkyl ester, canola oil alkyl ester, corn oil alkyl ester, alkyl palmitate, alkyl stearate, alkyl oleate, sulfonated castor oil, mineral oil, paraffin oil, low molecular level polybutene, wax, wax emulsion or a mixture of thereof.

The non-ionic surfactant can be a linear alcohol ethoxylate, branched alcohol ethoxylate, poly(ethylene glycol)mono- or di-ester of various fatty acids, poly(ethylene glycol) alkyl ether, ethylene oxide/propylene oxide homo- and copolymers, or poly(ethylene oxide-co-propylene oxide)alkyl ester or ether, ethoxylated castor oil, or ethoxylated polymethylalkylsiloxanes, ethoxylated sorbitan derivatives, sorbitan fatty acid esters.

One preferred embodiment of the invention uses a composition comprising a mixture of hydrophobic imidazoline, vegetable oil, and ethoxylated linear or branched alcohol.

One preferred embodiment of the invention uses a composition comprising a mixture of hydrophobic imidazoline, vegetable oil, and ethoxylated linear and low molecular weight polybutene.

One preferred embodiment of the invention uses a composition comprising a mixture of a) hydrophobic imidazoline, b) hydrophobic non-cyclic aminoamide, c) one or a mixture of fatty acid alkyl esters, and d) ethoxylated linear or branched alcohol.

One preferred embodiment of the invention uses a composition comprising a) hydrophobic imidazoline, b) hydrophobic non-cyclic aminoamide, c) one or a mixture of fatty acid alkyl esters, and d) a combination of sorbitan fatty acid ester and ethoxylated sorbitan fatty acid ester.

The non-ionic surfactant can be a linear or branched alcohol ethoxylate with HLB values within 0 to 20, preferably 6 to 16, more preferably 8 to 12. When a linear or branched alcohol ethoxylate is used in the invention, it has at least 1 ethylene glycol units, and preferably at least 3 ethylene glycol units.

In some aspects of the invention the non-ionic surfactant is a mixture of ethoxylated sorbitan derivative and sorbitan fatty acid ester with HLB values within 0 to 20, more preferably 4 to 16.

In some embodiments of the invention the hydrophobic imidazoline, hydrophobic amine, hydrophobic material and non-ionic surfactant are blended together. The amount of hydrophobic material based on dry weight of the total composition ranges from 0% to 99% by dry weight, from 1% to 99% by dry weight, preferably from 33.3% to 96.8%, and more preferably from 85.7% and 96.8%, wherein the amounts of hydrophobically modified amines and nonionic surfactants each range from 0.0% to 99%, from 0.0% and 66.7%, preferably from 0 to 33.3, and more preferably 2.0% and 6.0%. The amount of hydrophobic imidazoline ranges from 0.5 to 100% by dry weight, preferably from 0.5 to 66.7%, preferably from 0.5 to 33.3%, preferably from 1 to 10%, and more preferably 2.0% and 6.0% based on dry weight of the composition.

In addition, it has been demonstrated that roll release can be improved even further when a small amount of fluorinated amine, preferably 0.5% to 15% by dry weight, is added to a blend of imidazoline, vegetable oil and non-ionic surfactant. In another example improvements in reduction of adhesion are made by blending small amounts of low molecular weight polybutenes with a mixture of imidazoline, vegetable oil and non-ionic surfactant. In another example improvements in reduction of adhesion are made by blending small amounts of hydrophobically modified silica with a mixture of imidazoline, vegetable oil and non-ionic surfactant According to the present invention, a release reducing additive or a combination of additives is applied to the surface of a center roll or a shoe press or any other surface where improvements in release are desired. A treatment composition is mixed with water to make a 1 to 10,000 ppm, more preferably 30 to 3000 ppm aqueous emulsion. Addition of the made-up emulsion is carried out through the showers. Treatments work well with or without presence of anionic trash in the water stream; presence of anionic trash enhances further the performance of quaternary hydrophobic amines.

Hydrophobic imidazolines when applied alone demonstrate efficient roll release at 500 ppm in deionized or white water (see Example 1 and data in Table 1). For compositions with hydrophobic materials, the levels of imidazolines can be reduced even below 100 ppm. In these compositions hydrophobes, e.g. mineral and vegetable oils are applied and blended with imidazolines and surfactants, wherein the levels of oils could range from 1 to 10,000 ppm, more preferably from 100 to 3,000 ppm.

Hydrophobic imidazolines, hydrophobically modified amines and non-ionic surfactant loads in aqueous solution are preferably in the range between 1 to 10,000 ppm for each, more preferably from 10 to 300 for each. Fluorinated amines can be added to aqueous compositions at 1 to 1000 ppm, more preferably from 25 to 200 ppm. The fluorinated amines can comprise from 0.5 to 85% by weight of the compositions, preferably from 0.5 to 15%, preferably from 2 to 10%, more preferably from 3 to 6% by dry weight of the composition.

In some of the aqueous compositions low molecular weight polybutenes can be added at 1 to 1,000 ppm levels, more preferably from 50 to 200 ppm. The polybutene can comprise from 0.5 to 12% by weight of the compositions, preferably from 2.5 to 10.5% by dry weight of the composition.

In other aqueous compositions hydrophobically modified silica can be added at 1 to 1,000 ppm levels, more preferably from 50 to 300 ppm. The hydrophobically modified silica can comprise from 0.5 to 15% by weight of the compositions, preferably from 2.5 to 10.5% by dry weight of the composition.

The treatments can be mixed with water and the resulting emulsions can be applied to the roll surfaces by showers, brushes or sprays.

The compositions mentioned above have demonstrated enhanced release effects upon testing on granite surfaces. Selected compositions have been tested and shown to be effective in roll release improvement on ceramic surface as well. Anyone skilled in the art can expect improved performance on other surfaces as well, including granite, ceramic, rubber, plastic, resin, composite material, polyurethane and others.

The present invention can be used to improve roll release in papermaking processes. Although it has been designed for applications in the press section, it may also be applied in other areas, for example, on wet end rolls, dryer cans and dryer fabric surfaces and calender stacks. Furthermore, it may be used in tissue mills for Yankee release applications.

The present invention will now be described with reference to a number of specific examples that are to be regarded as illustrative and not restricting the scope of the present invention.

EXAMPLES

The compositions of the present invention were evaluated for their ability to reduce adhesion of wet paper to roll surface materials in the following manner. A number of actives and compositions were tested on a OY Gadek Wet Web Release tester to measure their affects on resultant forces of adhesion. Actives and compositions were tested as 500 ppm and 1700 ppm aqueous solutions.

Imidazolines used in the tables include:

Imidazoline A is a cyclized reaction product of oleic acid with diethylenetiamine (with 2:1 ratio), quaternized with diethyl sulfate.

Imidazoline B is a mixture of cyclized imidazoline and linear mono- and bis-amides formed from the reaction of oleic acid and diethylenetriamine, quaternized with dimethyl sulfate.

Imidazoline C is a mixture of cyclized imidazoline and linear mono- and bis-amides formed from the reaction of oleic acid and diethylenetriamine, quaternized with diethyl sulfate.

Imidazoline D is a cyclized reaction product of oleic acid with diethylenetiamine, quaternized with dietyl sulfate (~90%) mixed with polyethylene glycol dioleate (~10%).

Roll cover materials were soaked in aqueous solutions or emulsions of the candidate materials, or otherwise the tested treatments were applied neat onto the roll surfaces by paint rollers. Wet handsheets were prepared and pressed onto the treated roll surfaces. Total solids of the wet sheets were in the range of 40-45%, typical for the press section of a papermaking machine. Forces of adhesion (in N/m) were measured by the wet web release tester and automatically recorded via the instrument's software. The release tests were performed with three replicates per condition. Descriptions for roll release tester and experimental details can also be found in TAPPI Journal, Vol. 82, NO. 6, 1996 by A. Alastalo, L. Neimo and H. Paulapuro.

The efficacies of the compositions of the present invention were determined by comparing the results of experiments preformed on treated roll surfaces versus blank experiments conducted without applying any of the compositions of the present invention. Table 1A summarizes these experiments; a benchmark product A-1, a mixture of mineral oil and nonionic surfactant, was provided for comparison. Results are reported as absolute values of adhesion force for blank and treated surfaces (column 2) as well as relative effects expressed in % reduction vs blank treatment (column 3). The data presented is an average of 3 measurements per treatment.

In the Examples and Tables below samples with notations A, C, D or P have been used as references and for comparisons, whereas samples with notations E, EC, AE, or ES are used as examples covered in the claims of the invention.

Example #1

TABLE 1A

| | | Adhesion Force (N/m) | |
|---|---|---|---|
| Sample | Chemistry of actives | Average | % Reduction |
| | Blank | 0.740 | |
| A-1 | Mineral oil/nonionic surfactant (benchmark) | 0.650 | 12.2 |
| | Blank | 0.727 | |
| C-2 | Fluorinated Low molecular weight-amine (perfluorohexyltriethylenetetraamine) | 0.397 | 45.4 |
| | Blank | 0.663 | |
| D-2 | Alkyl dimethyl benzyl ammonium chloride, (Mason Chemical) | 0.547 | 17.5 |
| | Blank | 0.763 | |
| E-1 | Imidazoline D | 0.680 | 10.9 |
| | Blank | 0.720 | |
| E-2 | Imidazoline B | 0.637 | 11.5 |
| | Blank | 0.750 | |
| E-3 | Imidazoline C | 0.607 | 19.1 |
| | Blank | 0.630 | |
| E-4 | Tall oil hydroxyl imidazoline, CAS #68937-01-9 | 0.488 | 23.5 |
| | Blank | 0.647 | |
| E-5 | Imidazoline A | 0.427 | 34.0 |
| | Blank | 0.740 | |
| E-6 | 1-Hydroxyethyl, 2 coco imidazoline, CAS #61791-38-6 | 0.397 | 46.4 |
| | Blank | 0.740 | |
| E-7 | 1-Hydroxyetyl, 2-heptadecenyl imidazoline, CAS #27136-73-8 | 0.333 | 55.0 |
| | Blank | 0.790 | |
| P-1 | $C_{16}$-hydrophobically modified - polyaminoamide | 0.723 | 8.5 |
| | Blank | 0.760 | |
| P-2 | Polyammoniumacrylate | 0.817 | −7.5 |
| | Blank | 0.750 | |
| P-3 | Polydiallyldimethylammonium chloride | 0.740 | 1.3 |

A number of hydrophobic amines have been tested at 500 ppm level in deionized water on granite surfaces. Roll release was evaluated vs. blank samples without any treatments.

Large reductions in adhesion forces are observed with low molecular weight hydrophobic amines, hydrophobic ammonium halides, hydrophobic tertiary and quaternized imidazolines, see results from C-2 to E-7. Polymeric amines did not perform as effectively as low molecular weight species, see examples from P-1 to P-3.

Based on testing results in deionized water it may appear that quaternized amines (e.g. first two in Table 1-B) are less efficient compared to neutral amines (the last one in the same table). However, in synthetic white water the difference becomes insignificant. It could be due to partial or complete neutralization of cationic charge by anionic species in white water.

TABLE 1-B

| Treatment | Dosage ppm | Adhesion Force Reduction (%) Di water | White water |
|---|---|---|---|
| Quaternized oleyl imidazoline | 500 | 34.0 | 30.0 |
| Alkyl dimethyl benzyl ammonium chloride | 500 | 17.5 | 22.8 |
| 1-hydroxyetyl, 2-heptadecenyl imidazoline | 500 | 55.0 | 32.0 |

Example #2

Three component blends were made in 5.9/88, 2/5.9 ratio and these mixtures were tested on a roll release tester. The testing was run in synthetic white water to simulate conditions in a paper mill. White water was made according to procedure described in TAPPI Journal, Vol. 81, N0.6, 1997 by D. T. Nguyen. The amount of anionic trash in white water was maintained at a 100 ppm level. Compositions were tested at a 1700 ppm concentration (100 ppm: 1500 ppm: 100 ppm). Results are summarized in Table 2 below. In the following example the Vegetable oil-A is soy oil and vegetable oil-B is corn oil, linear alcohol ethoxylate has CAS #68551-12-2, branched alcohol ethoxylate has CAS #, 24938-91-8, vegetable oil ester was canola oil methyl ester, fatty acid alkyl ester was Isopropyl palmitate, sorbitan oleate has CAS #1338-43-8 and ethoxylated sorbitan oleate has CAS #9005-65-6, the fluorinated amine was perfluorohexyl triethylenetetraamine The benchmark used was a product consisting of mineral oil and non-ionic surfactant.

TABLE 2

| Sample | Chemistry of formulations | Adhesion Force (N/m) Average | % Reduction |
|---|---|---|---|
| | Blank | 0.740 | |
| A-1 | Mineral oil/nonionic surfactant (Benchmark) | 0.650 | 12.2 |
| | Blank | 0.800 | |
| A-2 | Vegetable oil-A/linear alcohol ethoxylate | 0.697 | 12.9 |
| | Blank | 0.750 | |
| A-3 | Fatty acid alkyl ester/branched alcohol ethoxylate | 0.623 | 16.9 |
| | Blank | 0.783 | |
| C-21 | Fluorinated amine/vegetable oil-A/linear alcohol ethoxylate | 0.350 | 55.3 |
| | Blank | 0.663 | |
| D-21 | Alkyl dimethyl benzyl ammonium chloride/vegetable oil-A/linear alcohol ethoxylate | 0.517 | 22.0 |
| | Blank | 0.763 | |
| E-11 | Imidazoline D/vegetable oil-A/linear alcohol ethoxylate | 0.537 | 29.7 |
| | Blank | 0.750 | |
| E-31 | Imidazoline C/linear aminoamide-2/vegetable oil-A/linear alcohol ethoxylate | 0.570 | 24.0 |
| | Blank | 0.717 | |
| E-61 | 1-Hydroxyetyl, 2-heptadecenyl imidazoline/vegetable oil-A/linear alcohol ethoxylate | 0.500 | 30.3 |
| | Blank | 0.747 | |
| E-21 | Imidazoline B/fatty acid alkyl ester/sufonated castor oil | 0.527 | 29.5 |
| | Blank | 0.720 | |
| E-22 | Imidazoline B/vegetable oil methyl ester/sufonated castor oil | 0.433 | 40.9 |
| | Blank | 0.720 | |
| E-23 | Imidazoline B/fatty acid alkyl ester/branched alcohol ethoxylate | 0.337 | 53.2 |
| | Blank | 0.720 | |
| E-24 | Imidazoline B/vegetable oil ester/branched alcohol ethoxylate | 0.337 | 53.2 |
| | Bank | 0.723 | |
| E-25 | Imidazoline B/fatty acid alkyl ester/sorbitan oleate/ethoxylated sorbitan oleate | 0.340 | 53.0 |
| | Blank | 0.723 | |
| E-26 | Imidazoline B/vegetable oil ester/sorbitan oleate/ethoxylated sorbitan oleate | 0.370 | 48.8 |
| | Blank | 0.767 | |
| E-51 | Imidazoline A/vegetable oil-A/branched alcohol ethoxylate | 0.433 | 40.9 |
| | Blank | 0.707 | |
| E-52 | Imidazoline A/vegetable oil-B/linear alcohol ethoxylate | 0.447 | 36.8 |
| | Blank | 0.733 | |
| E-53 | Imidazoline A/mineral oil/linear alcohol ethoxylate | 0.527 | 28.1 |
| | Blank | 0.800 | |
| E-54 | Imidazoline A/vegetable oil-A/linear alcohol ethoxylate | 0.487 | 39.1 |

When a hydrophobically modified imidazoline is added to the mixture of vegetable oil and non-ionic surfactant or to a mixture of vegetable oil alkyl ester and non-ionic surfactant, adhesion force reduction effect grows significantly.

Data indicate that a number of compositions containing hydrophobic imidazolines, are very effective in roll release improvement compared to both "blank" samples and the benchmark product.

Example #3

A number of four component systems have been evaluated by roll release testing method. Addition of a small amount of fluorinated amine (~3.0%) to a mixture of quaternized imidazoline, vegetable oil and non-ionic surfactant significantly improves release properties, see results below. In the following example the vegetable oil was soy oil, the linear alcohol ethoxylate has CAS #68551-12-2 and the fluoroamine was perfluorohexyl triethylenetetraamine.

TABLE C

| Sample | Chemisty of formulations | Adhesion Force (N/m) Average | % Reduction |
|---|---|---|---|
| | Blank | 0.897 | |
| E-54 | Imidazoline A/vegetable oil-A/linear alcohol ethoxylate (Dosage 100/1500/100 ppm) | 0.553 | 38.4 |
| | Blank | 0.897 | |
| EC-54 | Imidazoline A/vegetable oil-A/linear alcohol ethoxylate/fluoroamine (Dosage 100/1500/100/50 ppm) | 0.303 | 66.2 |

Similar trends are observed for treatments in which small amounts of low molecular weight polybutene (2.5 to 10.0%) are added to a mixture of quaternized imidazoline, vegetable oil and non-ionic surfactant. In the following example the vegetable oil was soy oil, the linear alcohol ethoxylate has CAS #68551-12-2 and the polybutene has CAS #9003-29-6.

TABLE D

| Sample | Chemistry of formulations | Adhesion Force (N/m) Average | % Reduction |
|---|---|---|---|
| | Blank | 0.707 | |
| E-54 | Imidazoline A/vegetable oil-A/linear alcohol ethoxylate (Dosage 100/1500/100 ppm) | 0.510 | 27.9 |
| | Blank | 0.667 | |
| E-55 | Imidazoline A/vegetable oil-A/linear alcohol ethoxylate/polybutene (Dosage 100/1500/100/50 ppm) | 0.467 | 36.3 |

Finally, additional improvements are observed for treatments in which small amounts of hydrophobically modified silica or silicones (2.5 to 10.0%) are added to a mixture of quaternized imidazoline, vegetable oil and non-ionic surfactant. In the following example the vegetable oil was soy oil, the linear alcohol ethoxylate has CAS #68551-12-2 and the hydrophobically modified silica (HB silica) is the experimental product.

TABLE E

| Sample | Chemistry of formulations | Adhesion Force (N/m) Average | % Reduction |
|---|---|---|---|
| | Blank | 0.860 | |
| E54 | Quaternized imidazoline/vegetable oil-A/linear alcohol ethoxylate, 100/1500/100 ppm | 0.537 | 37.6 |
| | Blank | 0.860 | |
| E56 | Quaternized imidazoline/vegetable oil-A/linear alcohol ethoxylate/HB silica 100/1500/100/50 ppm | 0.413 | 52.0 |

Example #4

Data in Table 3 indicate that both vegetable oil (A-2) and quaternized imidazoline (E-4) are capable of reducing adhesion to the roll surface. However, the combination of vegetable oil and quaternized imidazoline (sample AE-25) demonstrates the adhesion force reduction far exceeding expectations. This trend is observed both in deionized water (Test 1) and white water (Test 2). Based on the performance of individual components, adhesion force reductions of about 21% and 19% would be expected for the combinations in deionized water and synthetic white water, respectively. The realized reductions are twice as high as expected, at 41% (sample AE-25) and 39% (sample AE-25') respectively. Compositions of quaternized imidazoline with vegetable oil and non-ionic surfactant exhibit synergistic behavior.

Similar type synergistic enhancement in performance is observed when a mixture of cyclic imidazoline and linear hydrophobic amine (A-3) is combined with fatty acid alkyl ester and branched alcohol ethoxylate (E-2), see results in Table 3. In the following examples the vegetable oil used was soy oil and the linear alcohol ethoxylate has CAS #68551-12-2 the branched alcohol ethoxylate has CAS #, 24938-91-8, the fatty acid alkyl ester was ispropyl palmitate. Test 1 and 3 were done using DI water and Test 2 was done using synthetic white water.

TABLE 3

| Sample | Chemistry | Dosage ppm | Release Force (N/m) Average | % Reduction |
|---|---|---|---|---|
| Test 1 | Blank | | 0.737 | |
| A-2 | Vegetable oil-A/linear alcohol ethoxylate | 1500/100 | 0.637 | 13.6 |
| E-5 | Imidazoline A | 100 | 0.680 | 7.7 |
| AE-25 | Imidazoline A/vegetable oil-A/linear alcohol ethoxylate | 100/1500/100 | 0.433 | 41.3 |
| Test 2 | Blank | | 0.800 | |
| A-2' | Vegetable oil-A/linear alcohol ethoxylate | 1500/100 | 0.697 | 12.9 |
| E-5' | Imidazoline A | 100 | 0.753 | 5.9 |
| ES-5' | Imidazoline A/linear alcohol ethoxylate | 100/100 | 0.667 | 16.6 |
| AE-25' | Imidazoline A/vegetable oil-A/linear alcohol ethoxylate | 100/1500/100 | 0.487 | 30.1 |
| Test 3 | Blank | | 0.750 | |
| A-3 | Fatty acid alkyl ester/branched alcohol ethoxylate | 1500/100 | 0.623 | 16.9 |
| E-2 | Imidazoline B | 100 | 0.628 | 16.0 |
| ES-2 | Imidazoline B/branched alcohol ethoxylate | 100/100 | 0.575 | 22.7 |
| AE-23 | Imidazoline B/fatty acid alkyl ester/branched alcohol ethoxylate | 100/1500/100 | 0.297 | 60.4 |

Synergistic behavior is observed in cases when amine is combined with hydrophobic material, e.g. vegetable oil or fatty acid ester and non-ionic surfactant, as in examples AE-23, AE-25, and AE-25'.

Example #5

Examples 1 to 4 demonstrate the performance of hydrophobically modified imidazolines alone or in combination with other hydrophobic material(s) and surfactants on granite surface. It has also been demonstrated that the same materials efficiently reduce adhesion on ceramic surfaces. Results for selected three component compositions are given below.

TABLE F

| Sample | Chemistry of formulations | Adhesion Force (N/m) Average | % Reduction |
|---|---|---|---|
| | Blank | 0.747 | |
| E54 | Quaternized imidazoline/vegetable oil-A/linear alcohol ethoxylate, 100/1500/100 | 0.123 | 83.5 |
| | Blank | 0.790 | |
| E51 | Quaternized imidazoline/vegelable oil-A/linear alcohol ethoxylate/polybutene, 100/1500/100/50 ppm | 0.097 | 87.7 |
| | Blank | 0.803 | |
| E55 | Quaternized imidazoline/vegetable oil-A/branched alcohol ethoxylate, 100/1500/100 | 0.223 | 72.2 |

Example 6

A short term paper mill trial has been run to test the effects of three and four component compositions mentioned above on roll release. Three products have been tested: E-54, E-55 and E-51. Their compositions correspond to the compositions E-54, E-55 and E-51 from Examples 2, 3 and 5. All three products were mixed with shower water and then applied to the surface of ceramic press roll through showers.

The addition rate for Product E-54 was changed stepwise from 20 ml/min, to 40 ml/min and finally 60 ml/min which after mixing with water corresponded to 320, 640 and 960 ppm, respectively. Immediately after addition of the treatment to the roll surface a draw has been reduced to compensate the reduction in paper web adhesion to the roll surface. In addition, a change in position at which paper web detaches from the ceramic surface has been observed visually.

In the next run Product E-55 was added at 20 ml/min and then 40 ml/min rates. Additional reductions in the draw have been observed (similar to the results observed on a lab scale).

Finally, Product E-51 has been tested at 40 ml/min addition rate. The draw was still lower compared to the original baseline values. However it has been increased compared to that of more efficient Product E-55.

TABLE G

| Test/Run | Treatment | Feed rate ml/min | Machine draw fpm | % reduction |
|---|---|---|---|---|
| Test 1 | Baseline | | 80 | |
| run 1 | Product E-54 | 20 | 79 | 1 |
| run 2 | Product E-54 | 40 | 78 | 3 |
| run 3 | Product E-54 | 60 | 77 | 4 |
| Test 2 | | | | |
| run 1 | Product E-55 | 20 | 75 | 6 |
| run 2 | Product E-55 | 40 | 74 | 8 |
| Test 3 | | | | |
| run 1 | Product E-51 | 40 | 77 | 4 |

While the present invention has been described with respect to particular embodiments thereof, it is apparent that numerous other forms and modifications will be obvious to those skilled in the art. The invention described in this application generally should be construed to cover all such obvious forms and modifications, which are within the true scope of the present invention.

The invention claimed is:

1. A method of reducing paper web adhesion on a press roll surface composed of a material selected from the group consisting of granite, ceramic, and rubber and improving release from the roll surface in papermaking processes comprising applying to the press roll surface a composition comprising at least one low molecular weight hydrophobic imidazoline, wherein the molecular weight of the hydrophobic imidazoline is 1,000 daltons or less.

2. The method of claim 1, wherein the hydrophobic imidazoline comprises at least one hydrophobic group and one cyclic imidazoline structure.

3. The method of claim 1 wherein the composition further comprises one or more compounds selected from the group consisting of a) hydrophobically modified amines, b) hydrophobic materials, c) non-ionic surfactants, and d) mixtures thereof.

4. The method of claim 3, wherein the hydrophobic material is selected from the group consisting of vegetable oil, mineral oil, vegetable oil alkyl ester, vegetable oil derivative, fatty acid ester, and hydrocarbon or fluorinated material.

5. The method of claim 3, wherein the composition comprises at least one hydrophobically modified amine which is a primary, secondary, tertiary or quaternary amine or ammonium compound containing one or more hydrophobic groups wherein the groups are linear, branched, aromatic hydrocarbon chains or perfluorinated groups.

6. The method of claim 3, wherein the composition comprises at least one non-ionic surfactant wherein the nonionic surfactant is selected from the group consisting of a linear alcohol ethoxylate, branched alcohol ethoxylate, poly(ethylene glycol) mono- or di-ester of fatty acid, poly(ethylene glycol) alkyl ether, ethylene oxide/propylene oxide homo- and copolymers, or poly(ethylene oxide-co-propylene oxide) alkyl ester or ether, ethoxylated castor oil, or ethoxylated polymethyl-alkylsiloxanes, ethoxylated sorbitan derivatives, sorbitan fatty acid esters and combinations thereof.

7. The method of claim 3 wherein the composition comprises the hydrophobic material wherein the hydrophobic material comprises, vegetable oil, and the non ionic surfactant comprises ethoxylated linear or branched alcohol.

8. The method of claim 3 wherein the composition comprises hydrophobically modified amine, hydrophobic material and nonionic surfactant, wherein the hydrophobically modified amine comprises hydrophobic non-cyclic aminoamide; the hydrophobic material comprises one or more fatty acid alkyl esters or vegetable oil alkyl ester; and the nonionic surfactant comprises ethoxylated linear or branched alcohol.

9. The method of claim 3 wherein the composition comprises hydrophobically modified amine, hydrophobic material and nonionic surfactant wherein the hydrophobically modified amine comprises hydrophobic non-cyclic aminoamide; the hydrophobic material comprises one or more fatty acid alkyl esters or vegetable oil alkyl ester; and the nonionic surfactant comprises a combination of sorbitan fatty acid ester and ethoxylated sorbitan fatty acid ester.

10. The method of claim 3, wherein hydrophobic imidazoline, hydrophobically modified amine, hydrophobic material and non-ionic surfactant are blended together and wherein the amount of hydrophobic material varies from 33.3% to 96.8%.

11. The method of claim 1 wherein the composition further comprises vegetable oil and non-ionic surfactant.

12. The method of claim 1 wherein the composition further comprises linear aminoamide; fatty acid alkyl ester or vegetable oil ester; and non-ionic surfactant.

13. The method of claim 1 wherein the composition further comprises, vegetable oil, linear or branched alcohol ethoxylate, and polybutene.

14. The method of claim 13 wherein the amount of polybutene ranges from 0.5 to 12% by dry weight of the composition.

15. The method of claim 1 the composition further comprises vegetable oil, linear alcohol ethoxylate and fluorinated material.

16. The method of claim 15 wherein the amount of fluorinated material is from 0.5% to 15.0% by dry weight of the composition.

17. The method of claim 1 the composition further comprises vegetable oil, linear alcohol ethoxylate and hydrophobically modified silica or silicone compounds.

18. The method of claim 17 wherein the amount of hydrophobically modified silica or silicone material is from 0.5% to 15% by dry weight of the composition.

19. The method of claim 1 wherein the composition is in the form of an emulsion and is applied to the roll surfaces by showers, brushes or sprays.

* * * * *